US006433806B1

(12) United States Patent
Nishimura

(10) Patent No.: US 6,433,806 B1
(45) Date of Patent: Aug. 13, 2002

(54) THREE-HEADS ONE-PASS TYPE THERMAL PRINTER

(75) Inventor: Tomoyoshi Nishimura, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/043,091

(22) Filed: Jan. 14, 2002

(30) Foreign Application Priority Data

Jan. 15, 2001 (JP) ..... 2001-006830

(51) Int. Cl.[7] ..... B41J 2/32
(52) U.S. Cl. ..... 347/175
(58) Field of Search ..... 347/172, 173, 347/175, 200, 202, 206; 400/120.02, 120.03

(56) References Cited

U.S. PATENT DOCUMENTS 5,724,085 A * 3/1998 Inui et al. ..... 347/175

* cited by examiner

*Primary Examiner*—Huan Tran
(74) *Attorney, Agent, or Firm*—Sughrue Mion, PLLC

(57) ABSTRACT

A cyan thermal coloring layer, a magenta thermal coloring layer, and a yellow thermal coloring layer are successively formed on a base of a thermo-sensitive recording paper. A yellow thermal head, a magenta thermal head, and a cyan thermal head are disposed along a conveyance path. While the thermo-sensitive recording paper is being conveyed in the sub scanning direction along the conveyance path, three colors images are sequentially recorded by the three thermal heads. When the length of heat elements of the respective thermal heads are Ly, Lm and Lc in a sub scanning direction, it follows that Ly<Lm<Lc. When heated by the yellow thermal head, the isothermal curve shows minimum width in the surface of the thermo-sensitive recording paper. Meanwhile the isothermal curve of the cyan thermal head shows maximum width. By changing the isothermal curves of the three colors, the dots of the three colors are made equal in size.

12 Claims, 8 Drawing Sheets

43
44
45
13
Ry
Rm
Rc
43a
43b
43c
33a
34a
35a
26a
26b
26c 23
23a
33a
Py
46a
13
24
24a
34a
Pm
46b
25
25a
35a
Pc
46c

THREE-HEADS ONE-PASS TYPE THERMAL PRINTER

BACKGROUND OF THE INVENTION

1. Field of the Invention

The present invention relates to a printer and a thermal printing method, more particularly to a printer and a thermal printing method, for recording a color image on a thermal recording material at a single conveyance by use of plural thermal heads.

2. Description of the Prior Arts

It is used a color thermo-sensitive recording paper in a color thermal printer that has at least three thermo-sensitive coloring layers to be developed color by applying heat. The color thermo-sensitive recording paper is heated to record a full-color image thereon by the thermal head, as the color thermo-sensitive recording paper and the thermal head are relatively moved. The color thermo-sensitive paper is constituted by successively forming at least a cyan thermal coloring layer, a magenta thermal coloring layer, and a yellow thermal coloring layer on a substrate. Each thermal coloring layer has different thermal sensitivity so as to make each thermal coloring layer develop color selectively. The cyan thermal coloring layer of bottom layer is the lowest in the thermal sensitivity, whereas the yellow thermal coloring layer of top layer is the highest. The thermal recording is conducted in order from the yellow thermal coloring layer of the highest thermal sensitivity. An electromagnetic ray proper to the recorded thermal coloring layer is irradiated for optical fixation before the recording of the following thermal coloring layer, preventing the recorded thermal coloring layer from developing color again.

There are a one-head three-pass type and a three-head one-pass type in the color thermal printer. In the one-head three-pass type it is used a single thermal head that moves the color thermo-sensitive recording paper back and forth three times, to record a color image by three color frame sequential recording. In the three-head one-pass type a yellow thermal head, a magenta thermal head, and a cyan thermal head are disposed at suitable intervals from upstream along the conveyance path of the color thermo-sensitive recording paper. A yellow ultraviolet rays lamp is disposed between the yellow thermal head and the magenta thermal head. And a magenta ultraviolet rays lamp is disposed between the magenta thermal head and the cyan thermal head.

A yellow color image is heat-recorded on the yellow thermal coloring layer of the top layer by the yellow thermal head while conveying the color thermo-sensitive recording paper from upstream to downstream. After the heat recording of the yellow color image, the ultraviolet rays are irradiated from the yellow ultraviolet rays lamp, fixing the yellow thermal coloring layer optically. Then a magenta color image is heat-recorded on the magenta thermal coloring layer by the magenta thermal head. The magenta thermal head produces heat energy larger than the yellow thermal head. After the heat recording of the magenta color image, the ultraviolet rays are irradiated from the magenta ultraviolet rays lamp, fixing the magenta thermal coloring layer optically. And finally, a cyan color image is heat-recorded on the cyan thermal coloring layer by the cyan thermal head. The yellow color image, the magenta color image, and the cyan color image are sequentially heat-recorded and optical-fixed while conveying the color thermo-sensitive recording paper from upstream to downstream, forming a full color image on the color thermo-sensitive recording paper.

A thermal head of the same structure is used in the thermal printer of the three-head one-pass type for the heat recording on each thermal coloring layer. Since the respective thermal coloring layers are different in depth, a difference is created in the isothermal curve of each thermal coloring layer, varying dot size that due to color. Therefore, the dot size of the yellow thermal coloring layer of the top layer becomes large, whereas that of the cyan thermal coloring layer of the bottom layer becomes small. The dot size is different in each three color, resulting in color blurring of the black letter or a reduction in printing resolution.

SUMMARY OF THE INVENTION

An object of the present invention is to provide a printer and a thermal printing method that equalizes the dot size of each color.

Another object of the present invention is to provide a printer and a thermal printing method that consist of simple structure for equalizing the dot size of each color.

And final object of the present invention is to provide a printer and a thermal printing method that prevent occurrence of the color blurring and a reduction in the printing resolution.

To achieve the above and other objects, according to the thermal printing method of the present invention, the lower the thermal coloring layer is, the wider the isothermal curve is widened in the surface of a thermal recording material. That is, a cyan thermal head for recording a cyan thermal coloring layer of the bottom layer is widened the area for heating the color thermo-sensitive recording paper in comparison with a yellow thermal head for recording a yellow thermal coloring layer of the top layer. A magenta thermal head for recording a magenta thermal coloring layer of the middle layer is the middle of the cyan thermal head and the yellow thermal head.

According to the thermal printer of the present invention, the heating element of the cyan thermal head is longer than that of the yellow thermal head in a sub scanning direction. According to another embodiment of the present invention, the partial glaze of the cyan thermal head is longer than that of the yellow thermal head in the radius of curvature. According to the third embodiment of the present invention, the partial glaze of the cyan thermal head is thicker than that of the yellow thermal head. According to the fourth embodiment of the present invention, the cyan platen rollers which nip the color thermo-sensitive recording paper with the cyan thermal head has a larger diameter in comparison with the yellow platen rollers. And finally according to the fifth embodiment, the cyan thermal head is cooled stronger than the yellow thermal head.

According to the present invention, the longer the distance between the thermal head and the thermal-sensitive coloring layer, the wider the isothermal curve becomes. Therefore it is possible to equalize the size of dot for each color.

BRIEF DESCRIPTION OF THE DRAWINGS

The above objects and advantages of the present invention will become apparent from the following detailed description of the preferred embodiments when read in association with the accompanying drawings.

DETAILED DESCRIPTION OF THE EMBODIMENTS

Figure 1:
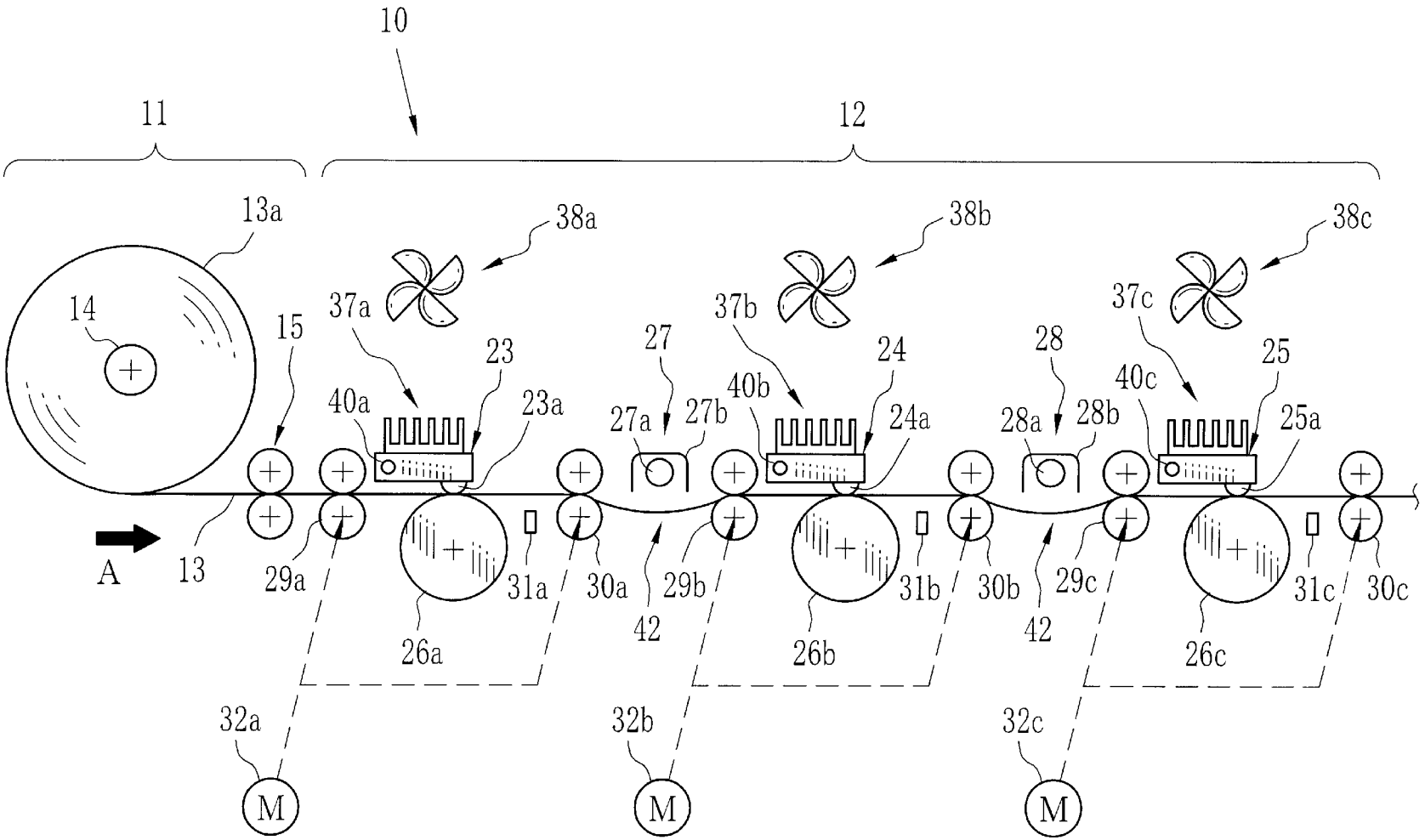
FIG. 1 is a schematic view of a thermal printer that is embodied in the present invention.

In FIG. 1, a color thermal printer 10 is a three-head one-pass type, being constituted of a feed section 11 and an image recording section 12. A recording sheet roll 13*a*, which is wounded a color thermo-sensitive recording paper 13 in a roll, is rotatably supported by a revolving shaft 14. Being nipped from the recording sheet roll 13*a* by a feed mechanism 15, the color thermo-sensitive recording paper 13 is conveyed to the image recording section 12 in the arrow direction A. The color thermo-sensitive recording paper 13, as is well known, is successively formed by a yellow thermo-sensitive coloring layer 17, a magenta thermo-sensitive coloring layer 18 and a cyan thermo-sensitive coloring layer 19 on a base 20 (See FIG. 2). The yellow thermo-sensitive coloring layer 17 of the top layer is the highest in heat sensitivity whereas the cyan thermo-sensitive coloring layer 19 of the bottom layer is the lowest. A transparent middle layer (not shown) for controlling heat sensitivity is formed between the respective thermo-sensitive coloring layers. Furthermore, a transparent protective layer (not shown) is formed on the yellow thermo-sensitive coloring layer 17.

The image recording section 12 consists of a yellow thermal head 23, a magenta thermal head 24, a cyan thermal head 25, platen rollers 26*a*–26*c*, a yellow fixing device 27, a magenta fixing device 28, conveyor roller pairs 29*a*–29*c*, 30*a*–30*c*, edge sensors 31*a*–31*c* and so forth.

The conveyor roller pairs 29*a*–29*c*, 30*a*–30*c* are respectively arranged upstream and downstream of each thermal head 23–25. They nip the color thermo-sensitive recording paper 13 supplied from the feed section 11 to convey it to the arrow direction A. The edge sensors 31*a*–31*c*, which are respectively arranged between the platen rollers 26*a*–26*c* and the conveyor roller pairs 30*a*–30*c*, sends a detecting signal to a system controller (not shown) on detecting the tip of the color thermo-sensitive recording paper 13. Each conveyor roller pairs 29*a*–29*c*, 30*a*–30*c* are rotated by pulse motors 32*a*–32*c*. The pulse motors 32*a*–32*c* are controlled to rotate by the system controller. The system controller counts a driving plus of the pulse motors 32*a*–32*c* when a detecting signal is inputted from the edge sensors 31*a*–31*c*. The conveyance amount of the color thermo-sensitive recording paper 13 is measured from the numerical value so as to specify the print starting position, the cutting position and the forth. Of the conveyor roller pairs 29*a*–29*c*, 30*a*–30*c*, the upper sides are pinch rollers, while the lower sides are capstan rollers. When the tip of the color thermo-sensitive recording paper 13 reaches to the position, the pinch rollers move to be in a nipped state.

The yellow thermal head 23, the magenta thermal head 24, and the cyan thermal head 25 are successively arranged along the conveyance path of the color thermo-sensitive recording paper 13. And the platen rollers 26*a*–26*c* are arranged opposing to each respective thermal head 23–25.

Each thermal head 23–25 has bulging partial glazes 23*a*, 24*a*, and 25*a*. Heating element arrays 33, 34, 35 in which plural heating elements 33*a*, 34*a*, and 35*a* (See FIG. 3) are arranged in line along the main scanning direction (the direction of the width of the color thermo-sensitive recording paper 13) are formed on the partial glazes 23*a*, 24*a*, and 25*a*. Heat sinks 37*a*–37*c* are disposed on each thermal head 23–35. Further, cooling fans 38*a*–38*c* are arranged over the heat sinks 37*a*–37*c* for sending air towards the heat sinks 37*a*–37*c*.

Each thermal head 23–35 is swingably supported by supporting axes 40*a*–40*c*. By the shift mechanism (not shown), each thermal head 23–35 is selectively set either a recording position to press the color thermo-sensitive recording paper 13 on the platen rollers 26*a*–26*c* by each heating element array 33–35 or a retracting position to detach thereby. The system controller energizes each heating element 33*a*–35*a* through the head driver (not shown) when the color thermo-sensitive recording paper 13 is conveyed to the arrow direction A. When the respective heating element 33*a*–35*a* generate heat at a predetermined temperature in accordance with each color image data, the heat energy is supplied to the color thermo-sensitive recording paper 13, causing each thermo-sensitive coloring layer 17–19 to develop color selectively. The platen rollers 26*a*–26*c*, at that moment, follow in accordance with the color thermo-sensitive recording paper 13 being conveyed.

Figure 3C:
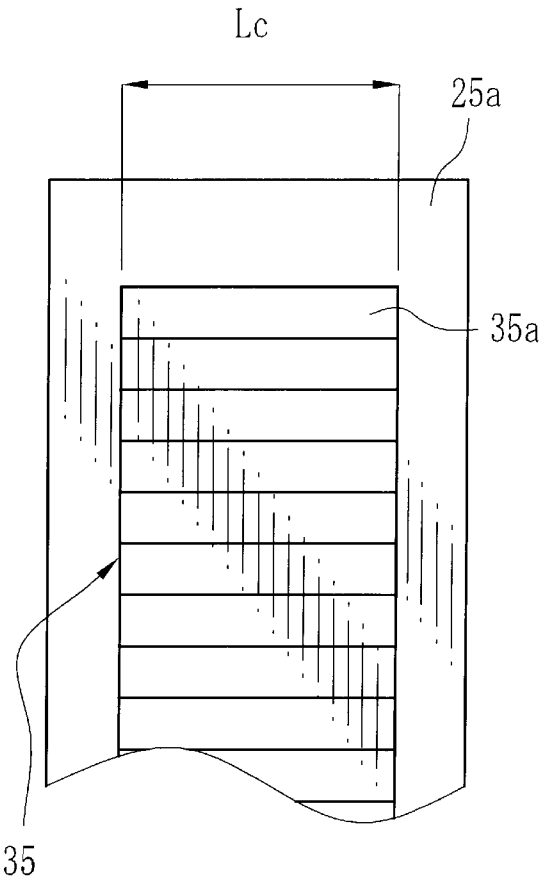
FIGS. 3(*a*), 3(*b*) and 3(*c*) are top views illustrating three colors thermal heads whose heating elements are different in the sub scanning direction in width.
Figure 3B:
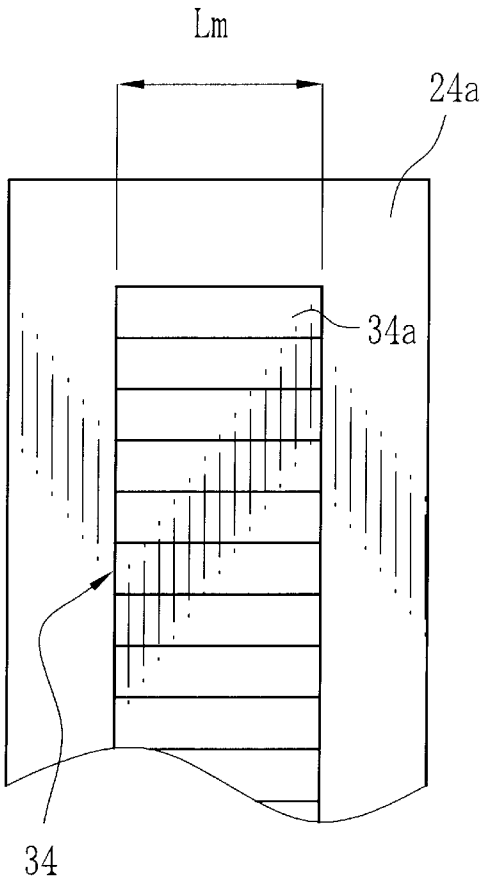
Figure 3A:
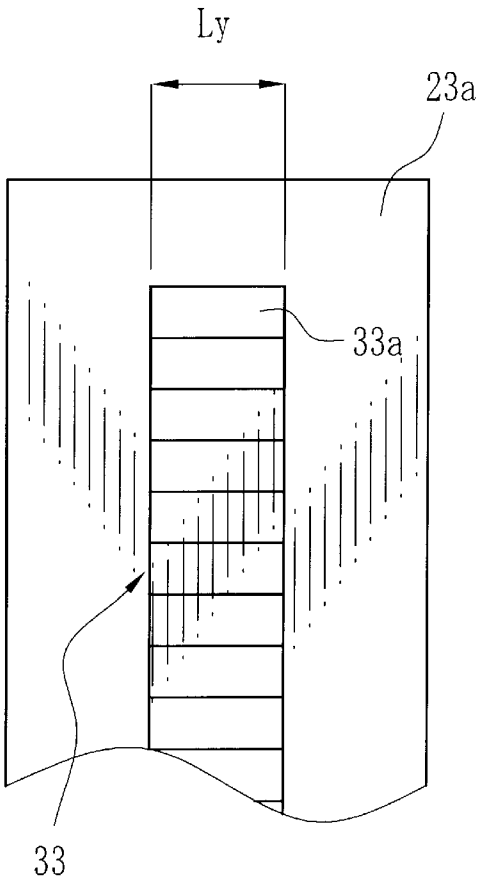

As shown in FIG. 3A–3C, when the heating element 33*a* of the yellow thermal head 23, the heating element 34*a* of the magenta thermal head 24, and the heating element 35*a* of the cyan thermal head 25 are respectively Ly, Lm and Lc in length of the sub scanning direction (the conveyance direction of the color thermo-sensitive recording paper 13), it follows that Ly<Lm<Lc.

Figure 2:
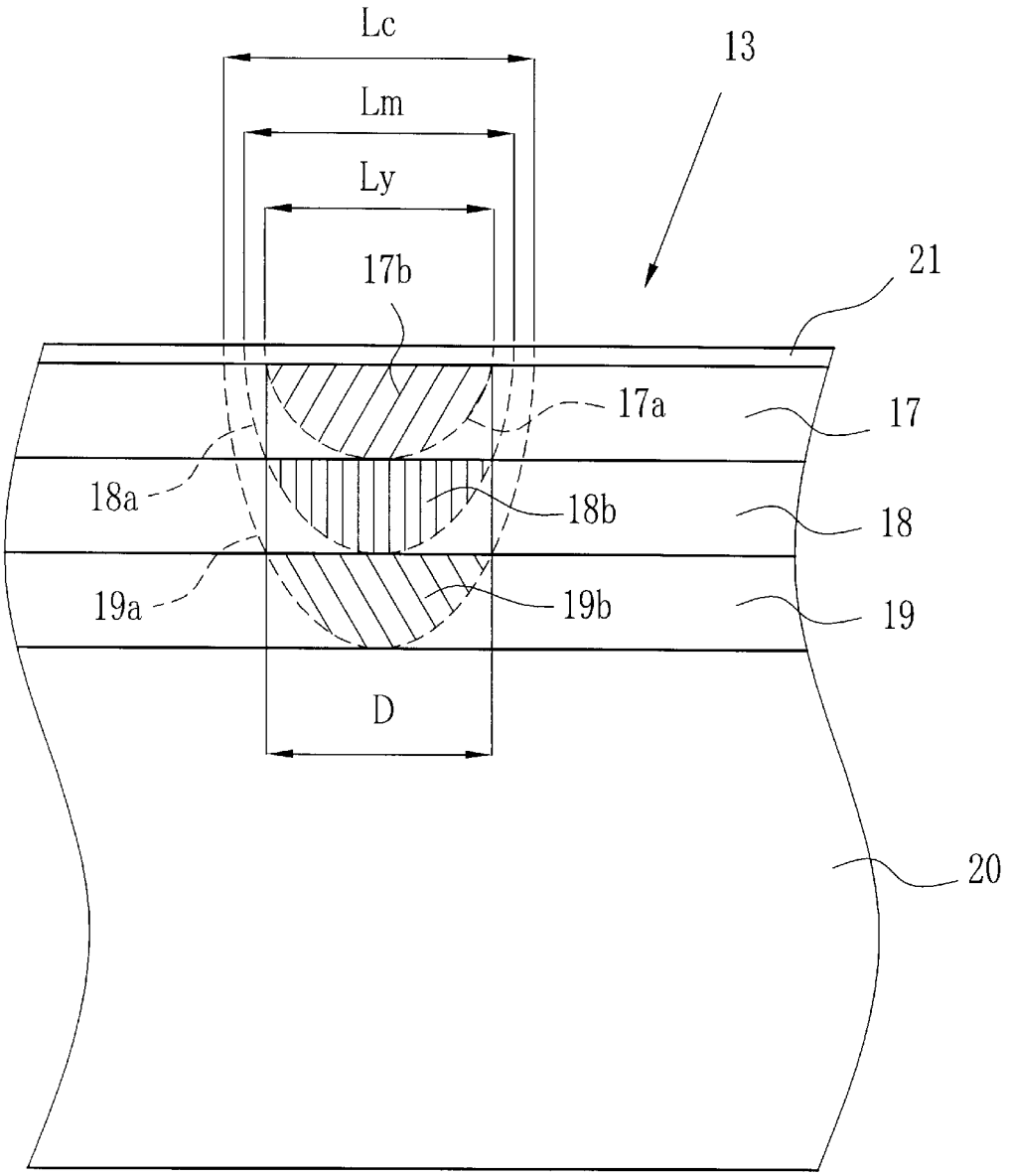
FIG. 2 is an explanatory view illustrating an isothermal curve of each thermal coloring layer.

The yellow thermo-sensitive coloring layer 17 is the shortest in the contact length of the heating element 33*a* with the color thermo-sensitive recording paper 13. The isothermal curve 17*a* shown by broken lines in FIG. 2 is the smallest in size of the surface of the color thermo-sensitive recording paper 13. Meanwhile, the cyan thermo-sensitive coloring layer 19 is the longest in the contact length of the heating element 35*a* with the color thermo-sensitive recording paper 13. The isothermal curve 19*a* is the largest in size of the surface of the color thermo-sensitive recording paper 13. And the isothermal curve 18*a* of the magenta thermal coloring layer 18 is the middle. Since the size of each isothermal curve 17*a*, 18*a*, and 19*a* is changed in accordance with the depth from the surface of the thermo-sensitive coloring layers of each color, each dot that develops color 17*b*, 18*b*, and 19*b* becomes approximately the same size D. It prevents a reduction in resolution, color blurring and so forth from occurring because the size of the dots 17*b*–19*b* is different in each thermal coloring layer. The lengths of the respective heating element 33*a*–35*a* Ly, Lm, and Lc are appropriately determined according to the diameter of the platen roller 26, the radius of curvature of the partial glaze 23*a*–25*a* and so forth.

The yellow fixing device 27 is disposed between the yellow thermal head 23 and the magenta thermal head 24. And the magenta fixing device 28 is disposed between the magenta thermal head 24 and the cyan thermal head 25. The yellow fixing device 27, which consists of an ultraviolet rays lamp 27*a* which emits ultraviolet rays of 420 nm at its peak and a reflector 27*b*, to fix the recorded yellow thermo-sensitive coloring layer 17 optically. Similarly, the magenta fixing device 28, which consists of an ultraviolet rays lamp 28*a* which emits ultraviolet rays of 365 nm at its peak and a reflector 28*b*, to fix the recorded magenta thermo-sensitive coloring layer 18 optically.

The thermo-sensitive recording paper 13 has a predetermined amount of sag 42 at the positions of the yellow fixing device 27 and the magenta fixing device 28. The sag 42 prevents the color thermo-sensitive recording paper 13 from being pulled down during the heat recording by the yellow thermal head 23 and the magenta thermal head 24.

The operation of the color thermal printer is explained. When the print key is operated to instruct the printing operation, the system controller lights the yellow fixing device 27 and the magenta fixing device 28. Further, the system controller not only rotates the pulse motors 32*a*–32*c*, but also causes the feed mechanism 15 to pull the color thermo-sensitive recording paper 13 from the recording sheet roll 13*a*, so as to convey it to the image recording section 12. The color thermo-sensitive recording paper 13, passing through between the yellow thermal head 23 and the platen roller 26*a* that are set to the retracting position, is conveyed toward the conveyor roller pairs 30*a* by the roller pairs 29*a*.

When the tip of the color thermo-sensitive recording paper 13 is delivered to the edge sensor 31 a, a detecting signal is sent to the system controller.

Receiving the detecting signal, the system controller starts to count the number of driving pulse of the pulse motor 32*a*, to measure the conveyance amount of the color thermo-sensitive recording paper 13. The color thermo-sensitive recording paper 13 is conveyed until the tip of the color thermo-sensitive recording paper 13 is nipped by the conveyor roller pairs 30*a*. Then the yellow thermal head 23 is set to the recording position.

The system controller causes each heating element 33*a* to generate heat in accordance with each yellow color image data through the head driver, recording yellow dots on the yellow thermal coloring layer 17 for a line. The yellow dot 17*b* is D in size. After the recording is finished for a line, the heat recording for the next line is performed. When the heat-recorded part by the yellow color image is delivered to the yellow fixing device 27, the ultraviolet ray is irradiated from the ultraviolet rays lamp 27*a*, to be fixed the yellow thermal coloring layer 17 optically.

The thermo-sensitive recording paper 13 with the yellow color image optically fixed, passing through between the magenta thermal head 24 and the platen roller 26*b* that are set to the retracting position, is conveyed towards the conveyor roller pairs 30*b* by the conveyor roller pairs 29*b*. Passing through the edge sensor 31*b*, the tip of the thermo-sensitive recording paper 13 is nipped by the conveyor roller pairs 30*b*. And the magenta thermal head 24 is set to the recording position. While the thermo-sensitive recording paper 13 is being conveyed by the conveyor roller pairs 30*b*, the magenta thermal head 24 is driven to record the magenta dots for a line on the magenta thermal coloring layer 18. The single line recorded on the magenta thermal coloring layer 18 is overlapped with a single line of the yellow color image. The magenta dot 18*b* is D in size. When the heat-recorded part by the magenta color image is delivered to the magenta fixing device 28, the ultraviolet ray is irradiated from the ultraviolet rays lamp 28*a*, to be fixed the magenta thermal coloring layer 18 optically.

Likewise, the tip of the thermo-sensitive recording paper 13 is nipped and conveyed by the conveyor roller pairs 30*c*. The cyan thermal head 25 is driven during the conveyance, recording the cyan dots for a line. The cyan dot 19*b* is D in size. The thermal head 25 records the cyan color image line by line. Each dot 17*b*–19*b* that develops color on the thermal coloring layer 17–19 is approximately the same size D and is overlapped each other. The color image is performed by the dots of three colors.

In the above embodiment, the length of the heat element in the sub scanning direction is changed in accordance with the color so that the isothermal curve is differentiated in accordance with the color. The dot sizes of the three colors can be made equal by changing the radius of curvatures of the partial glazes or the diameters of the platen rollers although the length of the heating element is equalized in the sub scanning direction. It is, needless to say, suitable to change both of the length of the heating elements in the sub scanning direction and the radius of curvatures of the partial glazes. It is also suitable to change the length of the heating element in the sub scanning direction, the radius of curvatures of the partial glazes, and the dimensions of the platen rollers.

Figures 4A, 4B, 4C:
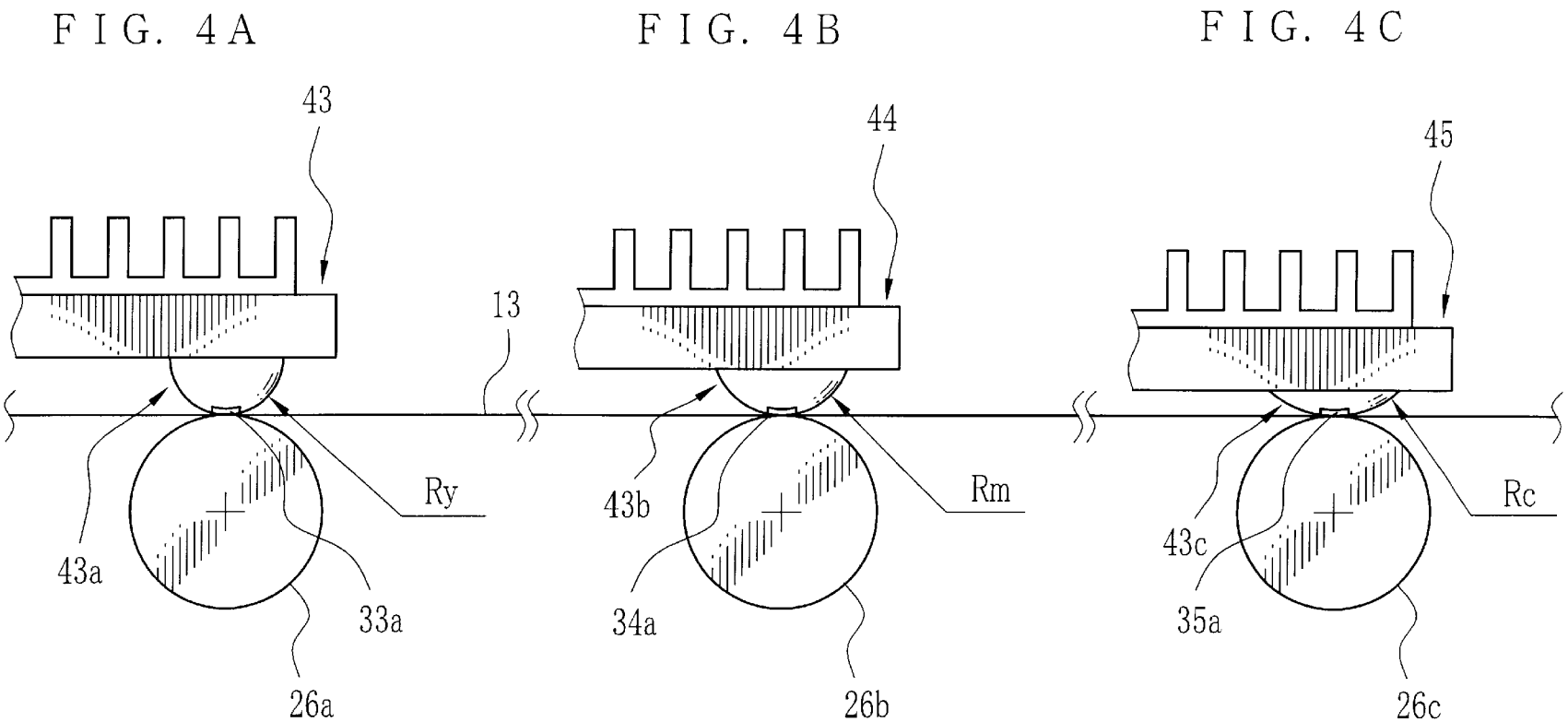
FIGS. 4(*a*), 4(*b*) and 4(*c*) are side views illustrating three colors thermal heads whose partial glazes are different in radius of curvature.

In an example shown by FIG. 4A–FIG. 4C, when the radius of curvature of a partial glaze 43*a* of the yellow thermal head 43, a partial glaze 44*a* of the magenta thermal head 44, and a partial glaze 45*a* of the cyan thermal head 45 are respectively as Ry, Rm, and Rc, it follows that Ry<Rm<Rc. The heating elements 33*a*, 34*a* and 35*a* are formed on the respective partial glazes 43*a*, 44*a*, and 45*a*. The length of these heating elements 33*a*, 34*a*, and 35*a* are the same in the sub scanning direction. With changes in the radius of curvature of the partial glazes 43*a*–45*a*, the contact length with the color thermo-sensitive recording paper 13 is altered. By changing the isothermal curves of three colors, therefore, the dots 17*b*–19*b* can be nearly equalized as D in size. In addition to that, if the heat energy that is conducted from the partial glaze to the color thermo-sensitive recording paper 13 is appropriately controlled, the outline of each dot 17*b*–19*b* can be prevented from blurring.

Figures 5A, 5B, 5C:
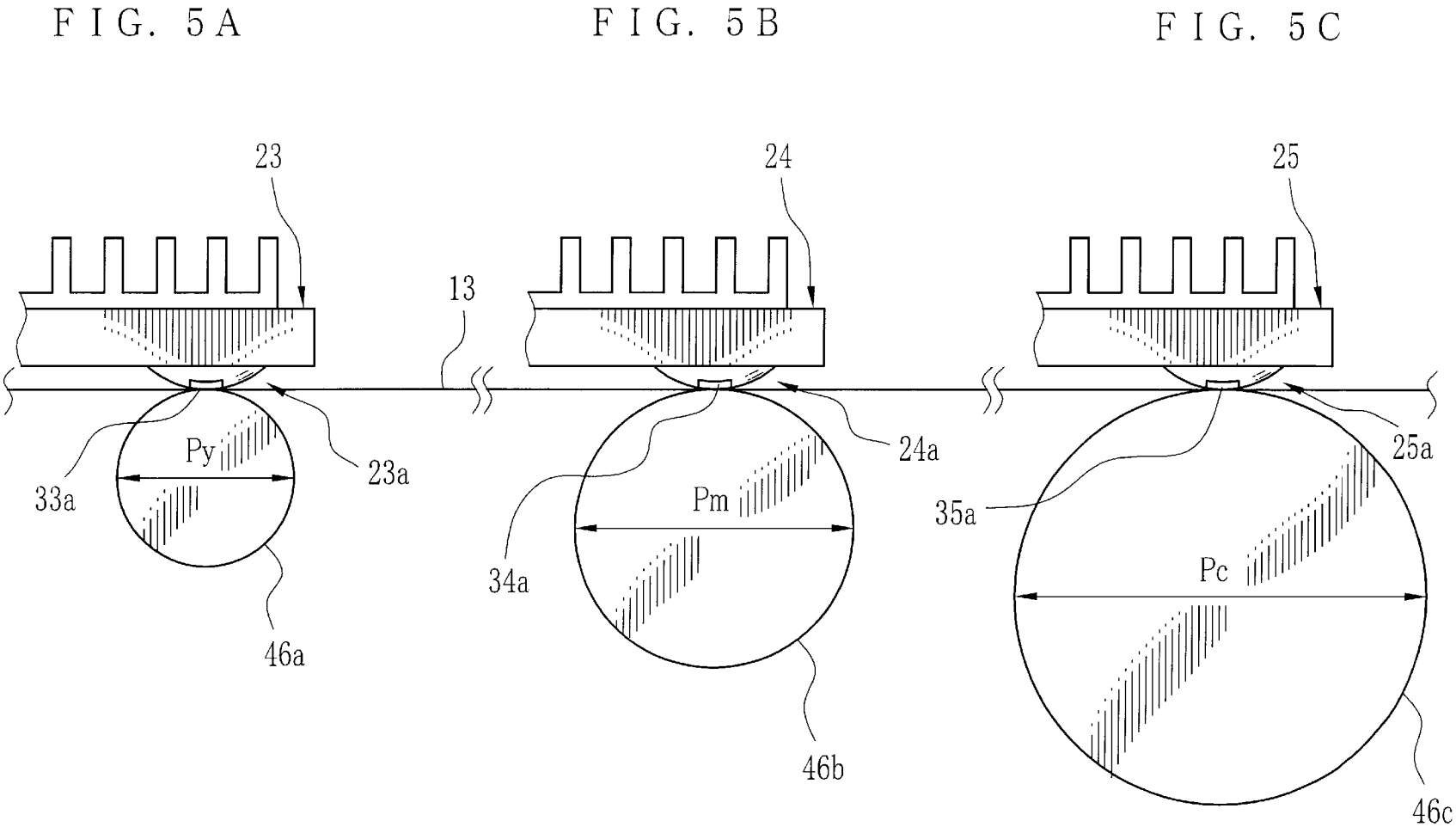
FIGS. 5(*a*), 5(*b*) and 5(*c*) are side views illustrating three colors platen rollers whose diameters are different.

In an example as shown in FIG. 5, when the diameters of a yellow platen roller 46*a*, a magenta platen roller 46*b*, and a cyan platen roller 46*c* are respectively defined as Py, Pm, and Pc, it follows that Py<Pm<Pc. Similarly the contact length of the partial glaze with the color thermo-sensitive recording paper 13 is altered.

According to the embodiment shown in FIG. 4, the contact length of the partial glaze with the color thermo-sensitive recording paper is altered. Instead, the length of heating elements in the sub scanning direction is sufficiently long. In the same way as the embodiment shown in FIG. 3, the contact length of the heat element with the color thermo-sensitive recording paper can be altered by altering the radius of curvature of the partial glaze. Also in the embodiment shown in FIG. 5, the contact length of the heat element with the color thermo-sensitive recording paper can be changed by altering the diameter of the platen rollers.

Figure 6A:
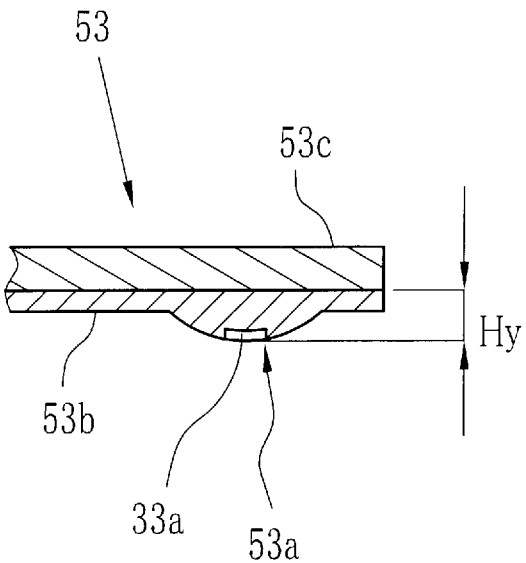
FIGS. 6(*a*), 6(*b*) and 6(*c*) are cross sections of three colors thermal heads whose partial glazes are different in height.
Figure 6B:
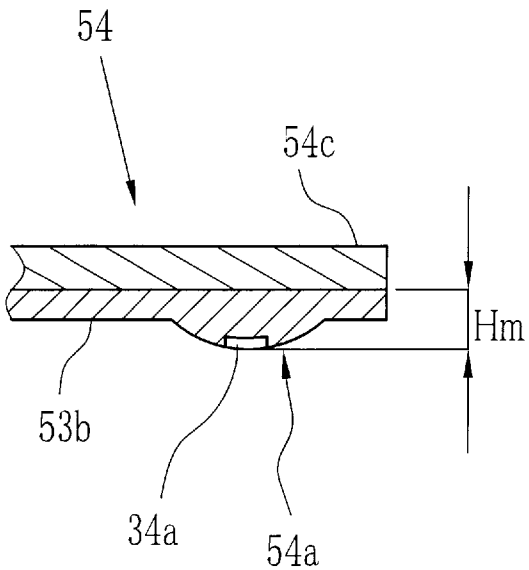
Figure 6C:
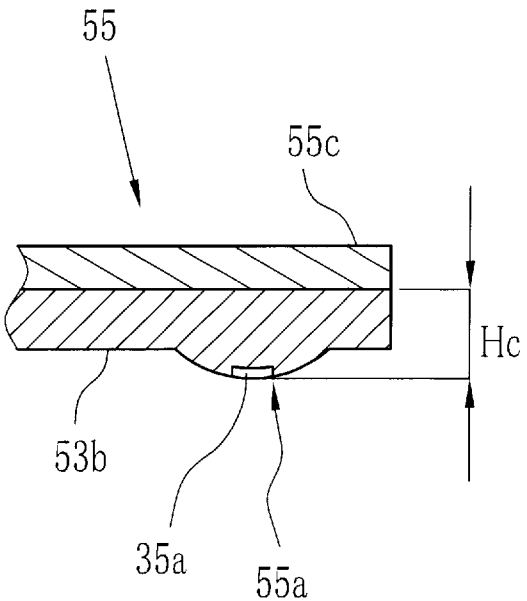

It is suitable to equalize the dot size of each color by changing heat transmission property of the thermal head against the color thermo-sensitive recording paper. In an example shown in FIG. 6, when a partial glaze 53*b* of a yellow thermal head 53, a partial glaze 54*b* of a magenta thermal head 54, and a partial glaze 55*b* of a cyan thermal head 55 are respectively Hy, Hm, and Hc in thickness, it follows that Hy<Hm<Hc. As the thermal head conducts the heat recording on the upper thermal coloring layer, the partial glaze becomes thinner. As a result, the heat can be concentrated around the heat element, preventing the dots on the upper thermal coloring layer from becoming unnecessarily large. The size of the dots 17*b*–19*b* on each thermal coloring layer 17–19 become the approximately same size D.

Figure 7A:
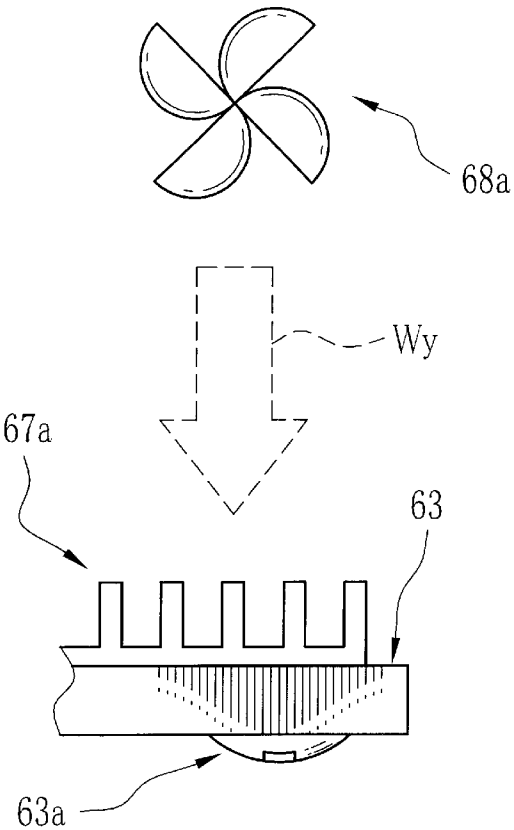
FIGS. 7(*a*), 7(*b*) and 7(*c*) are side views illustrating three colors cooling fans and thermal heads whose cooling properties are different.
Figure 7B:
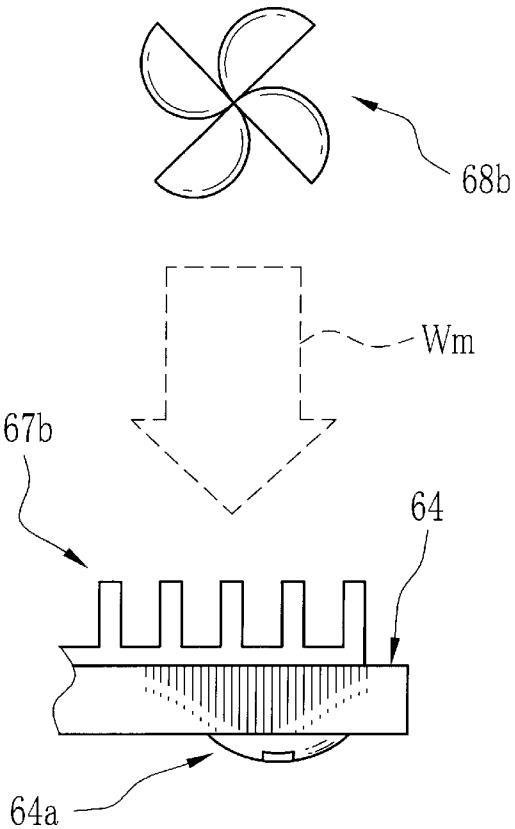
Figure 7C:
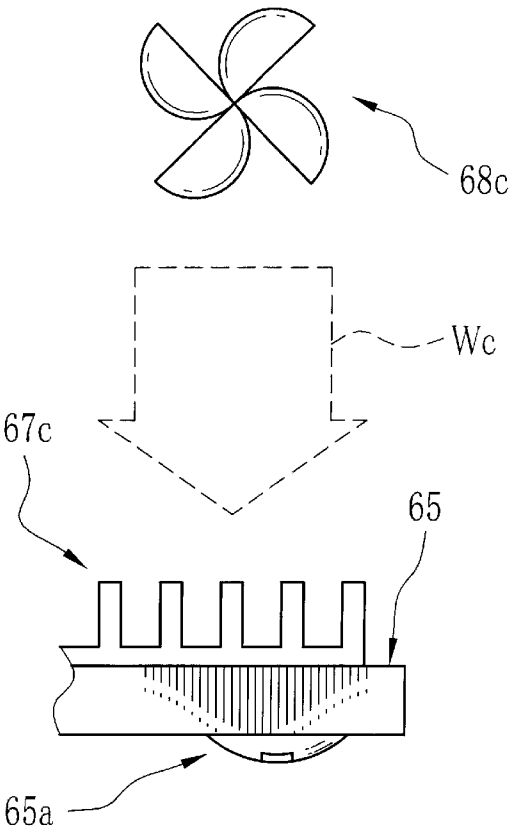
Figure 8A:
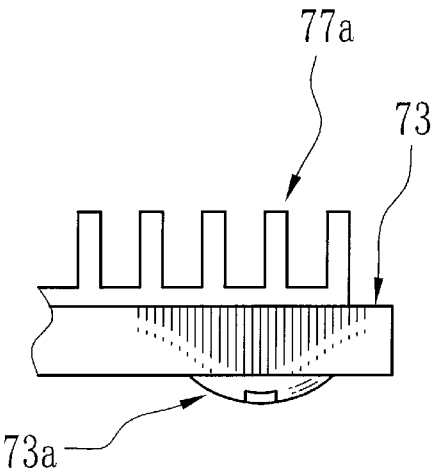
FIGS. 8(*a*), 8(*b*) and 8(*c*) are side views illustrating three colors thermal heads whose heat sinks are different in height.
Figure 8B:
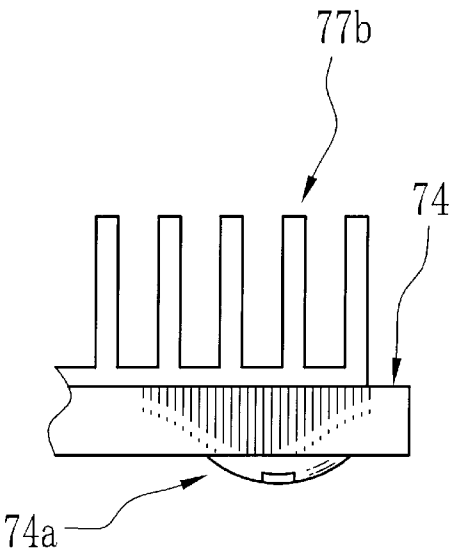
Figure 8C:
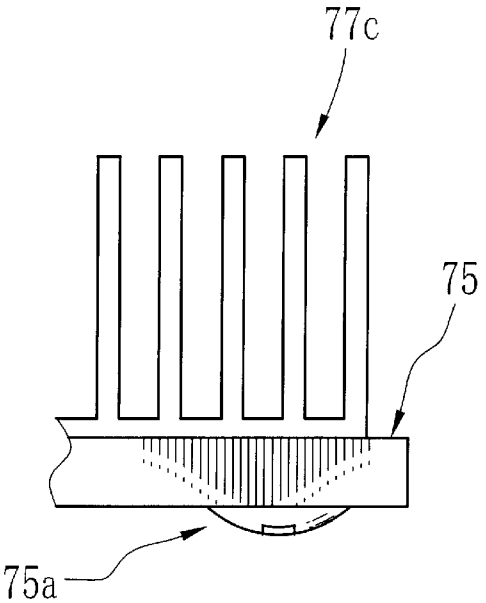

In an example shown in FIG. 7, when air flows of a yellow cooling fan 68*a*, a magenta cooling fan 68*b*, and a cyan cooling fan 68*c* are respectively Wy, Wm, and Wc, it follows that Wy<Wm<Wc. In an example as shown in FIG. 8, the height of the heat sink is set as follows; a yellow heat sink 77*a*<a magenta heat sink 77*b*<a cyan heat sink 77*c*. The higher the heat sink is, namely, the larger the surface area or the volume is, the more effective the cooling effect becomes. In other words, as the thermal head conducts the heat recording on the thermal coloring layer on the lower thermal coloring layer, the height of the heat sink is raised, for improving the cooling effect. The thermal head for recording the lower layer needs large power supply, meaning a high rise in temperature. Keeping an upward temperature in control prevents the dot in the lower thermal coloring layer from being unnecessarily enlarged. Consequently, the dots 17*b*–19*b* on each thermal coloring layer 17–19 can be made equal to size D more or less.

The above color thermo-sensitive recording paper is three-layered structure having the cyan thermal coloring layer, the magenta thermal coloring layer, and the yellow thermal coloring layer laid. However four-layered structure on which a black thermal coloring layer is added is also suitable. In this case, four thermal heads are used.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively, and three platen rollers being correspondent with these thermal heads, said thermal printing method comprising:

said first thermal coloring layer of bottom layer widening an isothermal curve on a surface of said thermo-sensitive recording material at maximum width on being heated by said first thermal head;

said third thermal coloring layer of top layer narrowing an isothermal curve on a surface of said thermo-sensitive recording material at minimum width on being heated by said third thermal head; and said second thermal coloring layer of middle layer making an isothermal curve on a surface of said thermo-sensitive recording material at middle width on being heated by said second thermal head.

2. A thermal printing method as claimed in claim 1, wherein said thermal heads have heating elements of different length in a conveyance direction of said thermo-sensitive recording material respectively so as to change said width of said isothermal curve due to color.

3. A thermal printing method as claimed in claim 1, wherein said respective thermal heads have different partial glazes in a radius of curvature so as to change said width of said isothermal curve due to color.

4. A thermal printing method as claimed in claim 1, wherein said respective thermal heads have different partial glazes in thickness so as to change said width of said isothermal curve due to color.

5. A thermal printing method as claimed in claim 1, wherein said platen rollers have different diameters respectively so as to change said width of said isothermal curve due to color.

6. A thermal printing method for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively, three platen rollers being correspondent with these thermal heads, and a first to a third head cooling devices for cooling said first to said third thermal heads respectively, said thermal printing method comprising:

a cooling property of said first cooling device being enlarged maximum when said first thermal coloring layer of bottom layer is heated by said first thermal head;

a cooling property of said third cooling device being reduced minimum when said third thermal coloring layer of top layer is heated by said third thermal head; and a cooling property of said second cooling device being made middle when said second thermal coloring layer of middle layer is heated by said second thermal head.

7. A thermal printer for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively and three platen rollers being correspondent with these thermal heads, said thermal printer comprising:

plural heating elements formed on said first thermal head for recording said first thermal coloring layer of bottom layer, said respective heating elements being longest in a conveyance direction of said thermal recording material;

plural heating elements formed on said third thermal head for recording said third thermal coloring layer of top layer, said respective heating elements being shortest in a conveyance direction of said thermal recording material; and plural heating elements formed on said second thermal head for recording said second thermal coloring layer of middle layer, said respective heating elements being middle in a conveyance direction of said thermal recording material.

8. A thermal printer for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively and three platen rollers being correspondent with these thermal heads, said thermal printer comprising;

a partial glaze formed on said first thermal head for recording said first thermal coloring layer of bottom layer, said partial glaze being largest in a radius of curvature;

a partial glaze formed on said third thermal head for recording said third thermal coloring layer of top layer, said partial glaze being smallest in a radius of curvature; and a partial glaze formed on said second thermal head for recording said second thermal coloring layer of middle layer, said partial glaze being middle in a radius of curvature.

9. A thermal printer for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively and three platen rollers being correspondent with these thermal heads, said thermal printer comprising;

a partial glaze formed on said first thermal head for recording said first thermal coloring layer of bottom layer, said partial glaze being largest in thickness;

a partial glaze formed on said third thermal head for recording said third thermal coloring layer of top layer, said partial glaze being smallest in thickness; and a partial glaze formed on said second thermal head for recording said second thermal coloring layer of middle layer, said partial glaze being middle in thickness.

10. A thermal printer for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively, said thermal printer comprising;

a first platen roller opposing said first thermal head for recording said first thermal coloring layer of bottom layer, said first platen roller being largest in diameter;

a second platen roller opposing said third thermal head for recording said third thermal coloring layer of top layer, said second platen roller being smallest in diameter; and a third platen roller opposing said second thermal head for recording said second thermal coloring layer of middle layer, said third platen roller being middle in diameter.

11. A thermal printer for printing a color image on a thermo-sensitive recording material while being conveyed from upstream to downstream of a conveyance path, said thermo-sensitive recording material being formed at least by a first thermal coloring layer, a second thermal coloring layer, and a third thermal coloring layer, said conveyance path arranging a first to a third thermal heads for developing color of each thermal coloring layer selectively, said thermal printer comprising;

a first cooling device for cooling said first thermal head for recording said first thermal coloring layer of bottom layer, said first cooling device being largest in cooling property;

a second cooling device for cooling said third thermal head for recording said third thermal coloring layer of top layer, said second cooling device being smallest in cooling property; and a third cooling device for cooling said second thermal head for recording said second thermal coloring layer of middle layer, said second cooling device being middle in cooling property.

12. A thermal printer as claimed in claim 11, wherein said thermal head is provided with a heat sink respectively, and the higher said cooling property is, the larger a surface area or a volume is.

* * * * *